US009259103B2

(12) United States Patent
Garg

(10) Patent No.: US 9,259,103 B2
(45) Date of Patent: Feb. 16, 2016

(54) COMBINATION-TYPE REFRIGERATING CABINET

(71) Applicant: Innovation Thru Energy Co., LTD, Tokyo (JP)

(72) Inventor: Pankaj Garg, Tokyo (JP)

(73) Assignee: INNOVATION THRU ENERGY CO., LTD., Tokyo (JP)

( * ) Notice: Subject to any disclaimer, the term of this patent is extended or adjusted under 35 U.S.C. 154(b) by 400 days.

(21) Appl. No.: 13/745,423

(22) Filed: Jan. 18, 2013

(65) Prior Publication Data

US 2013/0186123 A1 Jul. 25, 2013

(30) Foreign Application Priority Data

Jan. 20, 2012 (TW) ..... 101102420 A

(51) Int. Cl.

| | |
|---|---|
| ***A47F 3/04*** | (2006.01) |
| ***F25D 23/00*** | (2006.01) |
| ***F25D 16/00*** | (2006.01) |
| ***F25D 17/06*** | (2006.01) |
| *F25D 17/04* | (2006.01) |

(52) U.S. Cl.

CPC ..... *A47F 3/0408* (2013.01); *F25D 16/00* (2013.01); *F25D 17/065* (2013.01); *F25D 23/00* (2013.01); *A47F 3/0452* (2013.01); *F25B 2700/2117* (2013.01); *F25D 17/045* (2013.01); *F25D 2317/0665* (2013.01); *F25D 2317/0666* (2013.01); *F25D 2700/12* (2013.01); *F25D 2700/122* (2013.01)

(58) Field of Classification Search

CPC ... A47F 3/0408; A47F 3/0452; F25D 17/065; F25D 27/12; F25D 2317/0666; F25D 17/045; F25D 2700/2117; F25D 2317/0665; F25D 2700/122; F25B 2700/2117

USPC ..... 62/252, 255, 406, 430, 438, 439, 440

See application file for complete search history.

(56) References Cited

U.S. PATENT DOCUMENTS 2,907,186 A * 10/1959 Barroero ..... 62/408
3,584,467 A * 6/1971 Barroero ..... 62/252

(Continued)

FOREIGN PATENT DOCUMENTS

WO WO 2006008276 A1 * 1/2006 ..... F25B 39/02
WO WO 2006124004 A1 * 11/2006 ..... F25D 11/02

*Primary Examiner* — Emmanuel Duke

(74) *Attorney, Agent, or Firm* — Muncy, Geissler, Olds & Lowe, P.C.

(57) ABSTRACT

A combination-type refrigerating cabinet includes a cabinet body, a refrigeration-cycle unit and a pipe system. The cabinet body internally defines at least one cold accumulation chamber and a refrigerated cabinet internally having at least one refrigeration chamber, and at least one first air passage is provided between the cold accumulation chamber and the refrigerated cabinet. The cold accumulation chamber is internally provided with at least one cold accumulator, and the cold accumulator includes a case filled with a liquid cold accumulating material. The refrigeration-cycle unit separately supplies cold energy to the cold accumulation chamber and the refrigerated cabinet. The pipe system is provided between the cabinet body and the refrigeration-cycle unit, and includes a cold accumulation chamber pipeline communicating the refrigeration-cycle unit with the cold accumulation chamber and a refrigerated cabinet pipeline communicating the refrigeration-cycle unit with the refrigerated cabinet.

3 Claims, 7 Drawing Sheets

(56) References Cited

U.S. PATENT DOCUMENTS 4,918,936 A * 4/1990 Sakamoto ..... F25B 5/04 62/117
4,928,501 A * 5/1990 Negishi ..... F25D 3/06 62/406
4,951,481 A * 8/1990 Negishi ..... F25D 3/06 62/406
2004/0211215 A1* 10/2004 Maier-Laxhuber ..... F25B 17/08 62/480
2006/0168989 A1* 8/2006 Park ..... 62/408

* cited by examiner

COMBINATION-TYPE REFRIGERATING CABINET

TECHNICAL FIELD

The disclosure relates to a refrigerating cabinet, and relates to a combination-type refrigerating cabinet.

BACKGROUND

A conventional refrigerating cabinet or freezing cabinet obtains required cold energy from a refrigeration-cycle device, so as to cool or freeze foods or vegetables and fruits stored or displayed therein. The refrigeration-cycle device for the refrigerating cabinet or freezing cabinet includes a compressor, a condenser, an expansion valve and an evaporator, through which a coolant sequentially passes to circulate in the refrigeration-cycle device. The condenser releases heat energy while the evaporator produces cold energy, and the produced cold energy is supplied to the refrigerating cabinet or freezing cabinet for keeping an interior thereof at required low temperatures. The conventional refrigerating cabinet or freezing cabinet obtains the cold energy completely from the evaporator, and the cold energy is delivered to the interior of the refrigerating cabinet or freezing cabinet via air passages provided inside the refrigerating cabinet or freezing cabinet.

The conventional refrigerating cabinet or freezing cabinet may be a refrigerator or a refrigerated showcase. The refrigerated showcase may be an open refrigerated showcase or a closed refrigerated showcase, and the latter is openably closed by, for example, glass doors. The refrigerated showcases have been widely used in supermarkets and hypermarkets to hold and display foods to be sold. The refrigerated showcases not only function to keep the foods displayed therein in a fresh and hydrated state, but also effectively display the foods to be sold in an eye-catching manner to attract more consumers to buy them.

SUMMARY

The combination-type refrigerating cabinet according to a first embodiment of the disclosure includes a cabinet body, a refrigeration-cycle unit, and a pipe system. The cabinet body internally defines at least one cold accumulation chamber and a refrigerated cabinet internally having at least one refrigeration chamber. At least one first air passage is provided between the cold accumulation chamber and the refrigerated cabinet. The cold accumulation chamber is internally provided with at least one cold accumulator, and the cold accumulator includes a case filled with a liquid cold accumulating material. The refrigeration-cycle unit separately supplies cold energy to the cold accumulation chamber and the refrigerated cabinet. The pipe system is provided between the cabinet body and the refrigeration-cycle unit, and includes a cold accumulation chamber pipeline communicating the refrigeration-cycle unit with the cold accumulation chamber, and a refrigerated cabinet pipeline communicating the refrigeration-cycle unit with the refrigerated cabinet.

The combination-type refrigerating cabinet according to a second embodiment of the disclosure includes a display zone, a refrigeration-cycle unit, and a cold accumulation chamber. The display zone has a housing, in which a third partition board is provided closer to a rear side thereof, so that a gas passage is formed in the display-zone housing behind the third partition board. The third partition board has a plurality of third through holes formed thereon, via which the gas passage communicates with a space in the display zone in front of the third partition board. The refrigeration-cycle unit includes a compressor, a condenser, an expansion valve and an evaporator. The evaporator is located in a closed chamber, and cold energy produced by the evaporator is sent to the display zone by a fan. The closed chamber enclosing the evaporator is communicable with the gas passage via a sealing gate provided in the gas passage. The cold accumulation chamber is arranged between the refrigeration-cycle unit and the display zone to locate below the refrigeration-cycle unit and atop the display zone. The cold accumulation chamber is communicable with the closed chamber for the evaporator via a first partition board formed with one or more first through holes that are closable by a first closing member, and communicable with the display zone via a second partition board formed with one or more second through holes that are closable by a second closing member. The cold accumulation chamber is formed between the first and the second partition board and has one or more cold accumulators provided therein.

The combination-type refrigerating cabinet according to a third embodiment of the disclosure includes an upper display zone, a lower display zone, a refrigeration-cycle unit, and a cold accumulation chamber. The upper display zone is openably closed by doors. A fifth partition board is provided in the upper and the lower display zone closer to a rear side thereof, so that a gas passage is formed in the upper and lower display zones behind the fifth partition board. The fifth partition board has a plurality of fifth through holes formed thereon to communicate the gas passage with spaces of the upper and lower display zones in front of the fifth partition board; and the gas passage is internally provided with a sealing gate. The refrigeration-cycle unit includes a compressor, a condenser, an expansion valve and an evaporator. The evaporator is located in a closed chamber, and cold energy produced by the evaporator is sent to the upper and lower display zones by a fan. The closed chamber enclosing the evaporator is communicable with the gas passage via the sealing gate provided in the gas passage. The cold accumulation chamber is arranged between the refrigeration-cycle unit and the upper display zone to locate below the refrigeration-cycle unit and atop the upper display zone. The cold accumulation chamber is communicable with the closed chamber for the evaporator via a third partition board formed with one or more third through holes, and communicable with the upper display zone via a fourth partition board formed with one or more fourth through holes. And, the cold accumulation chamber has one or more cold accumulators provided therein.

BRIEF DESCRIPTION OF THE DRAWINGS

The structure and the technical means adopted by the disclosure to achieve the above and other objects can be best understood by referring to the following detailed description of the embodiments and the accompanying drawings, wherein.

DETAILED DESCRIPTION OF THE EMBODIMENTS

Figure 1:
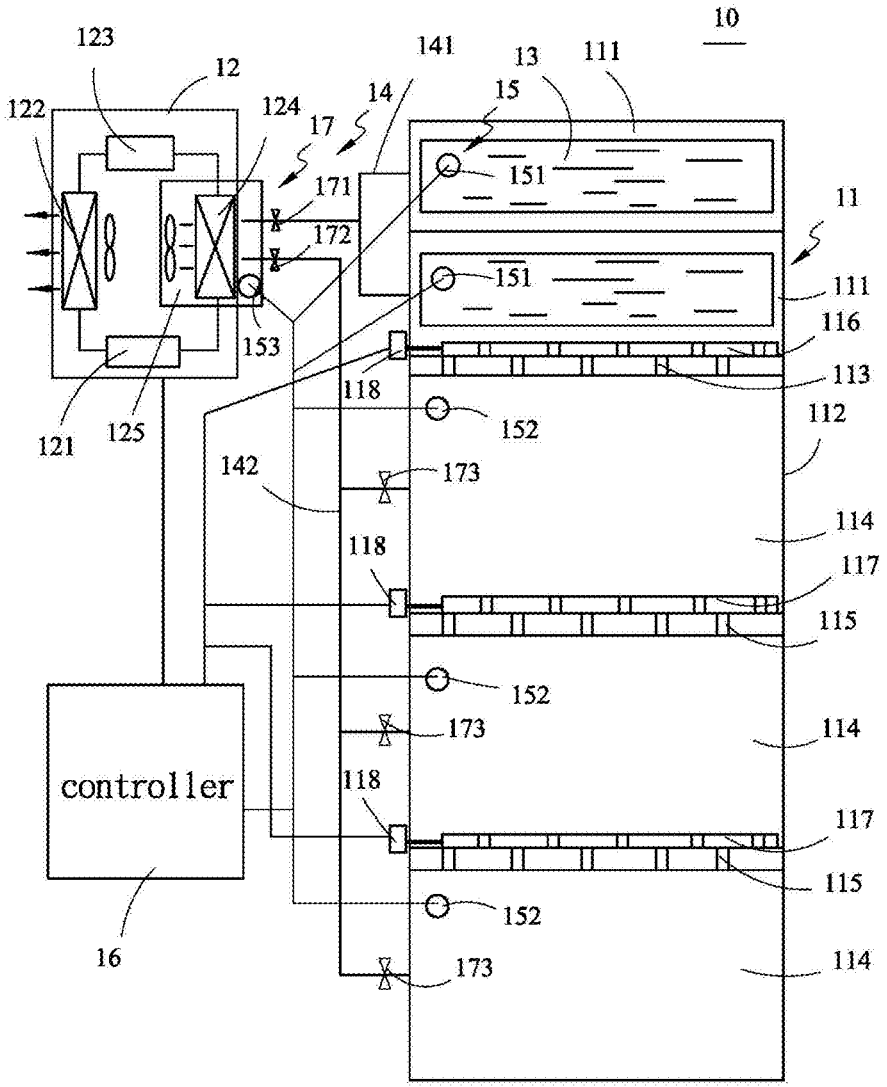
FIG. 1 is a schematic view of a combination-type refrigerating cabinet according to a first embodiment of the disclosure.

Please refer to FIG. 1 that is a schematic view of a combination-type refrigerating cabinet 10 according to a first embodiment of the disclosure. As shown, the combination-type refrigerating cabinet 10 includes a cabinet body 11, a refrigeration-cycle unit 12, at least one cold accumulator 13, and a pipe system 14.

The cabinet body 11 internally defines at least one cold accumulation chamber 111 and a refrigerated cabinet 112. At least one first air passage 113 is provided between the cold accumulation chamber 111 and the refrigerated cabinet 112, so that cold energy stored in the cold accumulation chamber 111 can be transferred to the refrigerated cabinet 112 via the first air passage 113. The refrigerated cabinet 112 internally has one or more refrigeration chambers 114. In the case of having multiple refrigeration chambers 114, at least one second air passage 115 is provided between any two adjacent refrigeration chambers 114. The refrigeration chambers 114 provide the function of maintaining foods stored therein in a fresh state. The at least one cold accumulator 13 is arranged in the cold accumulation chamber 111. Herein, the cold accumulator 13 refers to a case in which a liquid cold accumulating material is filled, and a heat accumulator refers to a case in which a liquid heat accumulating material is filled. Since the cold accumulator and the heat accumulator are known skills and their respective functions are same in all embodiments that will be described below, they are not repeatedly discussed in details herein. And, all the following embodiments are described based on the use of cold accumulators 13 in the cold accumulation chamber 111 for storing cold energy. The cold accumulation chamber 111 is located above the refrigerated cabinet 112. In the disclosure, the cabinet body 11, the cold accumulation chamber 111 and the refrigerated cabinet 112 all have walls made of a thermal insulating material, which may be a polyurethane (PU) foaming material, a vacuum-insulated material, vacuum-insulated panels, or different combinations thereof. Since the insulating walls are known skills, they are not discussed in details herein.

The refrigeration-cycle unit 12 produces and supplies cold energy to the cold accumulation chamber 111 and the refrigerated cabinet 112, and includes a compressor 121, a condenser 122, an expansion valve 123 and an evaporator 124. The compressor 121 compresses a low-temperature and low-pressure gas-phase coolant supplied therethrough into a high-temperature and high-pressure gas-phase coolant, which then flows through the condenser 122 to release heat energy and become a low-temperature and high-pressure liquid-phase coolant. Then, the expansion valve 123 reduces the pressure of the liquid-phase coolant flowed therethrough and properly controls the flow of the liquid-phase coolant. The low-temperature and low-pressure liquid-phase coolant then flows through the evaporator 124 to absorb heat and become vaporized, resulting in dropped external temperature. The low-temperature and low-pressure liquid-phase coolant is converted into low-temperature and low-pressure gas-phase coolant, which flows back into the compressor 121 and is compressed into a high-temperature and high-pressure gas-phase coolant again to start another cycle of the above-described operation. Since the operation of the refrigeration-cycle unit 12 is a known skill, it is not discussed in details herein.

The pipe system 14 is provided between the cabinet body 11 and the refrigeration-cycle unit 12, so that the refrigeration-cycle unit 12 supplies cold energy to the cold accumulation chamber 111 and the refrigerated cabinet 112 in the cabinet body 11 via the pipe system 14.

The pipe system 14 includes a cold accumulation chamber pipeline 141 and a refrigerated cabinet pipeline 142. The cold accumulation chamber pipeline 141 communicates the evaporator 124 of the refrigeration-cycle unit 12 with the cold accumulation chamber 111, and the refrigerated cabinet pipeline 142 communicates the evaporator 124 of the refrigeration-cycle unit 12 with the refrigerated cabinet 112. With these arrangements, the evaporator 124 of the refrigeration-cycle unit 12 can supply cold energy to the cold accumulation chamber 111 and the refrigerated cabinet 112 via the pipe system 14. The pipe system 14 has a first end and a second end. In the illustrated first embodiment, the first end of the pipe system 14 is connected to the evaporator 124 of the refrigeration-cycle unit 12, and the second end of the pipe system 14 is connected to the cold accumulation chamber 111 and the refrigerated cabinet 112. The evaporator 124 of the refrigeration-cycle unit 12 and the first end of the pipe system 14 are enclosed in a closed space 125.

The cold accumulation chamber pipeline 141 includes one or more pipes, which respectively communicate the evaporator 124 of the refrigeration-cycle unit 12 with one cold accumulation chamber 111. The refrigerated cabinet pipeline 142 includes one or more pipes, which respectively communicate the evaporator 124 of the refrigeration-cycle unit 12 with one refrigeration chamber 114 in the refrigerated cabinet 112.

The first air passage 113 between the cold accumulator chamber 111 and the refrigerated cabinet 112 is provided with a first closing member 116 for opening or closing the first air passage 112 under control. The second air passage 115 between two adjacent refrigeration chambers 114 is provided with a second closing member 117 for opening or closing the second air passage 115. The first closing member 116 and the second closing member 117 are respectively controlled by a motor 118 to move, so as to open or close the first air passage 113 and the second air passage 115, respectively. The first air passage 113 is a partition board having one or more through holes formed thereon; and the second air passage 115 is also a partition board having one or more through holes formed thereon.

The combination-type refrigerating cabinet of the disclosure combines at least one cold accumulation chamber 111 with a refrigerated cabinet 112. When the refrigeration-cycle unit 12 supplies cold energy to the cold accumulation chamber 111, the cold accumulators 13 in the cold accumulation chamber 111 store the cold energy supplied thereto. At the time the cold accumulation chamber 111 reaches a predetermined low temperature, the refrigeration-cycle unit 12 stops operating and the cold accumulation chamber 111 starts supplying the stored cold energy thereof to the refrigerated cabinet 112. In this manner, it is possible to use the cold energy to keep the stored foods fresh and hydrated for longer time while indirectly reducing the carbon dioxide emission in the environment. Unlike the prior art, the disclosure does not require any additional freezing unit for freezing the cold accumulators or any charging control unit. Further, the cold accumulators used for the disclosure have the function of automatically keeping desired humidity in the refrigerated cabinet 112, so that foods stored in the refrigerated cabinet 112 can maintain fresh and hydrated for a longer time.

The combination-type refrigerating cabinet according to the first embodiment of the disclosure further includes a plurality of temperature detectors 15 separately provided in the cold accumulation chambers 111 and the refrigeration chambers 114 of the refrigerated cabinet 112 for monitoring the temperature therein at any time, so as to determine whether to start or stop the refrigeration-cycle unit 12. The temperature detectors 15 are electrically connected to a controller 16, which starts or stops the refrigeration-cycle unit 12 according to signals received from the temperature detectors 15. The temperature detectors 15 include one or more first temperature detectors 151 for detecting the temperature in the one or more cold accumulation chambers 111, one or more second temperature detectors 152 for detecting the temperature in the one or more refrigeration chambers 114, and a third temperature detector 153 located at one side of the evaporator 124 of the refrigeration-cycle unit 12.

The first embodiment of the disclosure further includes a plurality of valves 17 separately connected to the pipes of the cold accumulation chamber pipeline 141 and the refrigerated cabinet pipeline 142. The controller 16 also controls the valves 17 to open or close according to the temperature detection signals fed by the temperature detectors 15 to the controller 16, so as to control the temperatures in the cold accumulation chambers 111 and the refrigeration chambers 114. The valves 17 includes a first valve 171 connected to the cold accumulation chamber pipeline 141, a second valve 172 connected to the refrigerated cabinet pipeline 142, and one or more third valves 173 connected to the pipes of the refrigerated cabinet pipeline 142 that communicate with the individual refrigeration chambers 114 in the refrigerated cabinet 112.

Figure 2:
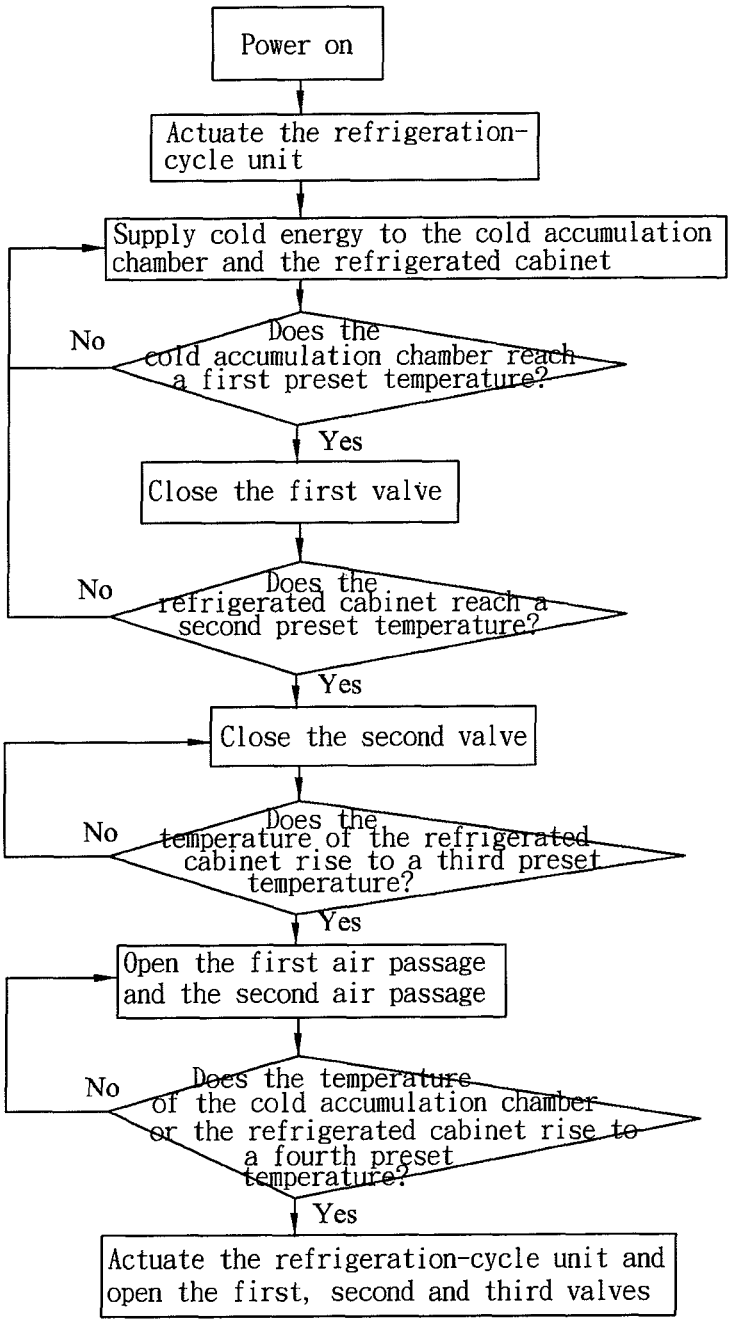
FIG. 2 is a flowchart showing the operation of the combination-type refrigerating cabinet according to the disclosure.

Please refer to FIG. 2 that is a flowchart showing the operation of the combination-type refrigerating cabinet 10 according to the first embodiment of the disclosure. When the combination-type refrigerating cabinet 10 is powered on, the refrigeration-cycle unit 12 is also actuated to produce and supply cold energy to the cold accumulator chambers 111 via the cold accumulation chamber pipeline 141, and to the refrigerated cabinet 112 via the refrigerated cabinet pipeline 142. At this point, the first valve 171 and the second valve 172 respectively connected to the cold accumulation chamber pipeline 141 and the refrigerated cabinet pipeline 142 are opened. When the cold accumulators 13 in the cold accumulation chambers 111 freeze and their temperature drops to a first preset temperature, the first temperature detectors 151 generate a first signal to the controller 16, which can be, for example, a programmable logic controller. And then, the controller 16 outputs a second signal to close the first valve 171. In the case the refrigerated cabinet 112 includes multiple refrigeration chambers 114, the second closing members 117 are moved to open the second air passages 115 between any two adjacent refrigeration chambers 114, so that the refrigeration chambers 114 in the refrigerated cabinet 112 communicate with one another, and the cold energy supplied by the refrigeration-cycle unit 12 can be delivered via the refrigerated cabinet pipeline 142 to each of the refrigeration chambers 114 in the refrigerated cabinet 112. At the time all the refrigeration chambers 114 reach a second preset temperature, the second temperature detectors 152 in the refrigeration chambers 114 generate a third signal to the controller 16. And then, the controller 16 outputs a fourth signal to close the second valve 172. On the other hand, when the temperature in the refrigerated cabinet 112 rises to a third preset temperature, the second temperature detectors 152 will generate a fifth signal to the controller 16. To maintain the interior of the refrigerated cabinet 112 at a desired low temperature, the controller 16 outputs a sixth signal to move the first closing member 116, so that the first air passage 113 between the cold accumulation chambers 111 and the refrigerated cabinet 112 is opened for the cold energy stored in the cold accumulation chambers 111 to move through the first air passage 113 and the second air passages 115 down to each of the refrigeration chambers 114 in the refrigerated cabinet 112, enabling the refrigeration chambers 114 to maintain below the third preset temperature for a period of time. In the illustrated first embodiment, the individual refrigeration chambers 114 may be controlled via corresponding third valves 173 to respectively maintain at a different temperature. Since the cold energy supplied by the cold accumulation chambers 111 sequentially moves downward to the individual refrigeration chambers 114, the refrigeration chambers 114 located at lower positions and accordingly farther away from the cold accumulation chambers 111 would have internal temperatures higher than that of the refrigeration chambers 114 located at higher positions and closer to the cold accumulation chambers 111. When the third valves 173 between the refrigeration-cycle unit 12 and the individual refrigeration chambers 114 are closed, the refrigeration chambers 114 being cooled by the cold accumulators 13 and having different temperatures may be used to keep different foods that require different storage temperature levels.

The third temperature detector 153 is arranged to one side of the evaporator 124 of the refrigeration-cycle unit 12, and is electrically connected to the controller 16. The third temperature detector 153 detects the temperature of the air output from the evaporator 124, enabling more accurate control of the temperatures of the cold accumulation chambers 111 and the refrigerated cabinet 112 by the controller 16.

When the cold accumulation chambers 111 or the refrigeration chambers 114 are detected to have an internal temperature risen above a fourth preset temperature, the first temperature detectors 151 in the cold accumulation chambers 111 generate a seventh signal to the controller 16, or the second temperature detectors 152 in the refrigeration chambers 114 generate an eighth signal to the controller 16, so that the controller 16 starts the refrigeration-cycle unit 12 again for the same to produce and supply cold energy to the cold accumulation chambers 111 and/or the refrigeration chambers 114. In this way, it is possible to use the cold energy to keep the stored foods fresh and hydrated for longer time while reducing the number of times of turning on/off the compressor 121 and indirectly reducing the carbon dioxide emission in the environment. Further, unlike the prior art, the disclosure does not require any additional freezing unit for freezing the cold accumulators or any charging control unit. Further, the cold accumulators used for the disclosure have the function of automatically keeping desired humidity in the refrigerated cabinet 112, so that foods stored in the refrigerated cabinet 112 can maintain fresh and hydrated for a longer time.

According to the structural design of the first embodiment of the disclosure, the first, the second, the third and the fourth preset temperature may be set to, for example, −18° C., −12° C., −5° C. and +5° C., respectively. In the disclosure, the cold accumulators 13 are set to maintain in a frozen state for 12 hours.

Figure 3:
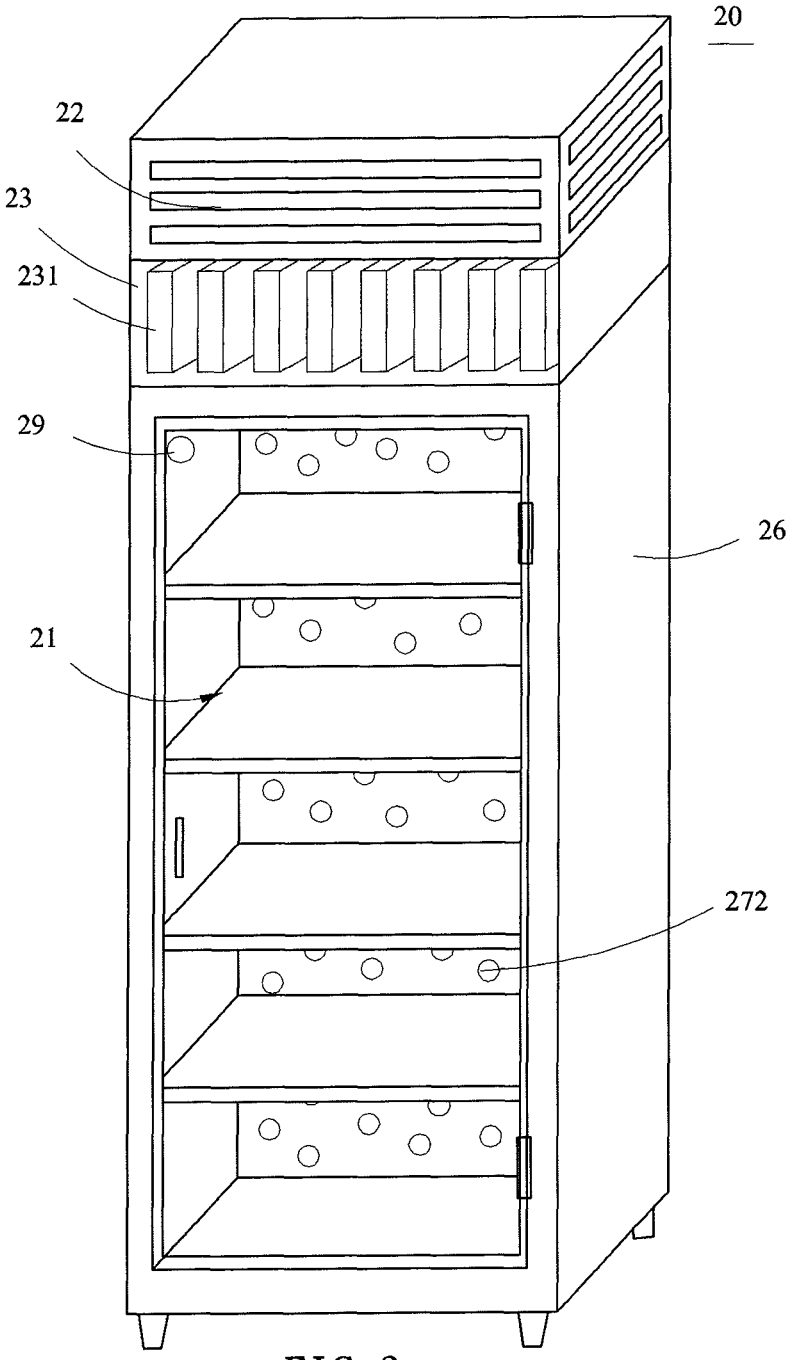
FIG. 3 is a front perspective view of a combination-type refrigerating cabinet according to a second embodiment of the disclosure.
Figure 4:
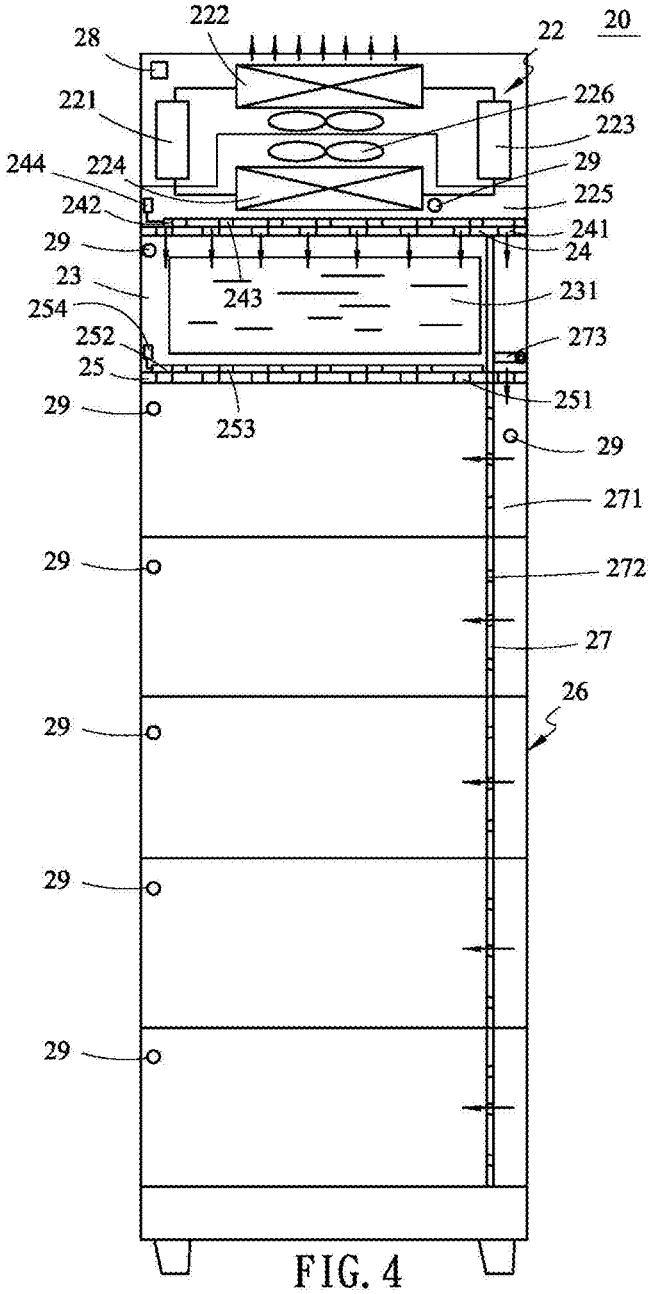
FIG. 4 is a sectional side view of the combination-type refrigerating cabinet according to the second embodiment of the disclosure.

FIGS. 3 and 4 are front perspective and sectional side views, respectively, of a combination-type refrigerating cabinet 20 according to a second embodiment of the disclosure. In the second embodiment, the combination-type refrigerating cabinet 20 is in the form of a refrigerated showcase and accordingly, also briefly referred to as a refrigerated showcase 20 herein. The refrigerated showcase 20 has a display zone 21, a refrigeration-cycle unit 22, and a cold accumulation chamber 23 located between the display zone 21 and the refrigeration-cycle unit 22. The cold accumulation chamber 23 is located atop the display zone 21 and below the refrigeration-cycle unit 22. When the refrigerated showcase 20 is powered on, the refrigeration-cycle unit 22 is actuated at the same time to produce cold energy.

The refrigeration-cycle unit 22 includes a compressor 221, a condenser 222, an expansion valve 223 and an evaporator 224. The evaporator 224 absorbs heat to produce cold energy, and the condenser 222 releases heat to produce heat energy. Thus, the refrigerated showcase 20 is designed to receive cold energy and release heat energy. The evaporator 224 is enclosed in a closed chamber 225 and isolated from external environment. The cold energy produced by the evaporator 224 is sent by a fan 226 to the display zone 21 and the cold accumulation chamber 23 of the refrigerated showcase 20. In the second embodiment, the known technical features of the refrigeration-cycle unit 22 are not repeatedly discussed herein to enable convenient and clear description of the disclosure. According to the second embodiment, the closed chamber 225 enclosing the evaporator 224 is communicable with the cold accumulation chamber 23 via a first partition board 24 having one or more first through holes 241 formed thereon; and the cold accumulation chamber 23 in turn communicates with the display zone 21 via a second partition board 25 having one or more second through holes 251 formed thereon. That is, the cold accumulation chamber 23 is formed between the first partition board 24 and the second partition board 25.

The refrigerated showcase 20 includes a housing 26 for the display zone 21. A third partition board 27 is provided in the display-zone housing 26 closer to a rear side thereof, so that a gas passage 271 is formed in the display-zone housing 26 behind the third partition board 27. The third partition board 27 has a plurality of third through holes 272 formed thereon, via which the gas passage 271 communicates with a space of the display zone 21 in front of the display zone 21. The gas passage 271 is also communicable with the closed chamber 225 enclosing the evaporator 224, such that cold energy produced by the evaporator 224 of the refrigeration-cycle unit 22 can be separately supplied to the display zone 21 via the gas passage 271 independent of the cold accumulation chamber 23. The cold accumulation chamber 23 is internally provided with one or more cold accumulators 231, which can become frozen when the cold energy produced by the refrigeration-cycle unit 22 is supplied into the cold accumulation chamber 23. The cold energy produced by the refrigeration-cycle unit 22 is also supplied into the display zone 21 via the gas passage 271 and the third through holes 272 formed on the third partition board 27, allowing the display zone 21 to hold and display foods that may be stored at a low temperature to keep cold.

In the second embodiment, the whole refrigerated showcase 20, including its display-zone housing 26, the first partition board 24 and the second partition board 25 all are made of a heat-insulating material.

According to the second embodiment, the disclosure further includes a controller 28 and a plurality of temperature detectors 29. The temperature detectors 29 are separately provided in the closed chamber 225 for the evaporator 224, the cold accumulation chamber 23, and the display zone 21.

When the display zone 21 is used to keep foods fresh, it requires a temperature different from that in the cold accumulation chamber 23. A sealing gate 273 for the gas passage 271 is closed first, so that the refrigeration-cycle unit 22 supplies cold energy only to the cold accumulation chamber 23 to freeze the cold accumulators 231 therein. In this case, the cold energy is supplied into the cold accumulation chamber 23 via the first through holes 241 on the first partition board 24, while the second through holes 251 on the second partition board 25 are closed by a corresponding second closing member 252.

The second closing member 252 has second vents 253 formed thereon and can be driven by a motor 254 to move, so that the second vents 253 are aligned with or offset from the second through holes 251 on the second partition board 25. When the second vents 253 are aligned with the second through holes 251, low-temperature gas from the cold accumulation chamber 23 is allowed to pass through the second partition board 25 into the display zone 21. On the other hand, when the second vents 253 are offset from the second through holes 251, no low-temperature gas from the cold accumulation chamber 23 is admitted into the display zone 21.

In the event the temperature detector 29 in the cold accumulation chamber 23 detects the temperature in the cold accumulation chamber 23 drops below a first preset temperature, indicating the cold accumulators 231 in the cold accumulation chamber 23 have become frozen, the temperature detector 29 will generate a signal to the controller 28, and the controller 28 in turn controls a first closing member 242 to close the first through holes 241 formed on the first partition board 24. The first closing member 242 has first vents 243 formed thereon, and can be driven by a corresponding motor 244 to move, so that the first vents 243 are aligned with or offset from the first through holes 241 on the first partition board 24. When the first vents 243 are aligned with the first through holes 241, low-temperature gas from the refrigeration-cycle unit 22 is allowed to pass through the first partition board 24 into the cold accumulation chamber 23. On the other hand, when the first vents 243 are offset from the first through holes 241, no low-temperature gas from the refrigeration-cycle unit 22 is admitted into the cold accumulation chamber 23. When the first partition board 24 is controlled by the controller 28 to close, the sealing gate 273 of the gas passage 271 is simultaneously opened under control of the controller 28, so that cold energy is directly supplied from the refrigeration-cycle unit 22 to the display zone 21.

When the temperature in the display zone 21 is detected by the corresponding temperature detectors 29 as having dropped to a second preset temperature, the sealing gate 273 between the refrigeration-cycle unit 22 and the gas passage 271 is closed. And, when the corresponding temperature detectors 29 detect the display zone 21 has an internal temperature risen to a third preset temperature, the second closing member 252 is driven to open the second partition board 25 under control, so that the cold energy stored by the cold accumulators 231 in the cold accumulation chamber 23 can be supplied via the second through holes 251 down into the display zone 21, enabling the latter to maintain at a temperature and humidity sufficient for keeping foods held therein in a fresh and hydrated state for a period of time. Then, when it is detected the display zone 21 or the cold accumulation chamber 23 has an internal temperature risen to a fourth preset temperature, the corresponding temperature detectors 29 generate a signal to the controller 28, and the controller 28 immediately actuates the refrigeration-cycle unit 22 to produce and supply cold energy to the cold accumulation chamber 23 or the display zone 21. In the case the cold accumulation chamber 23 has an internal temperature risen to a level that can no longer maintain the display zone 21 at a temperature required for keeping the displayed foods in the fresh and hydrated state, the controller 28 immediately opens the sealing gate 273 of the gas passage 271 while controlling the second closing member 252 to close the second through holes 251. In this manner, the temperature in the cold accumulation chamber 23 can drop again to freeze the cold accumulators 231, so that the cold accumulators 231 are prepared for supplying cold energy to the display zone 21 for use next time. By repeating the above-described operation cycle, it is possible to use the cold energy to keep the stored foods fresh and hydrated for longer time while reducing the number of times of turning on/off the compressor 121 and indirectly reducing the carbon dioxide emission in the environment. Further, unlike the prior art, the disclosure does not require any additional freezing unit for freezing the cold accumulators or any charging control unit. Further, the cold accumulators used for the disclosure have the function of automatically keeping desired humidity in the display zone 21, so that foods stored and displayed in the display zone 21 can maintain fresh and hydrated for a longer time.

In the second embodiment, the controller 28 is electrically connected to every temperature detector 29, the sealing gate 273, the first closing member 242, the second closing member 252 and the motors 244, 254. Accordingly, the first and the second closing member 242, 252 can be respectively driven by the motors 244, 254 to move under control of the controller 28.

Figure 5:
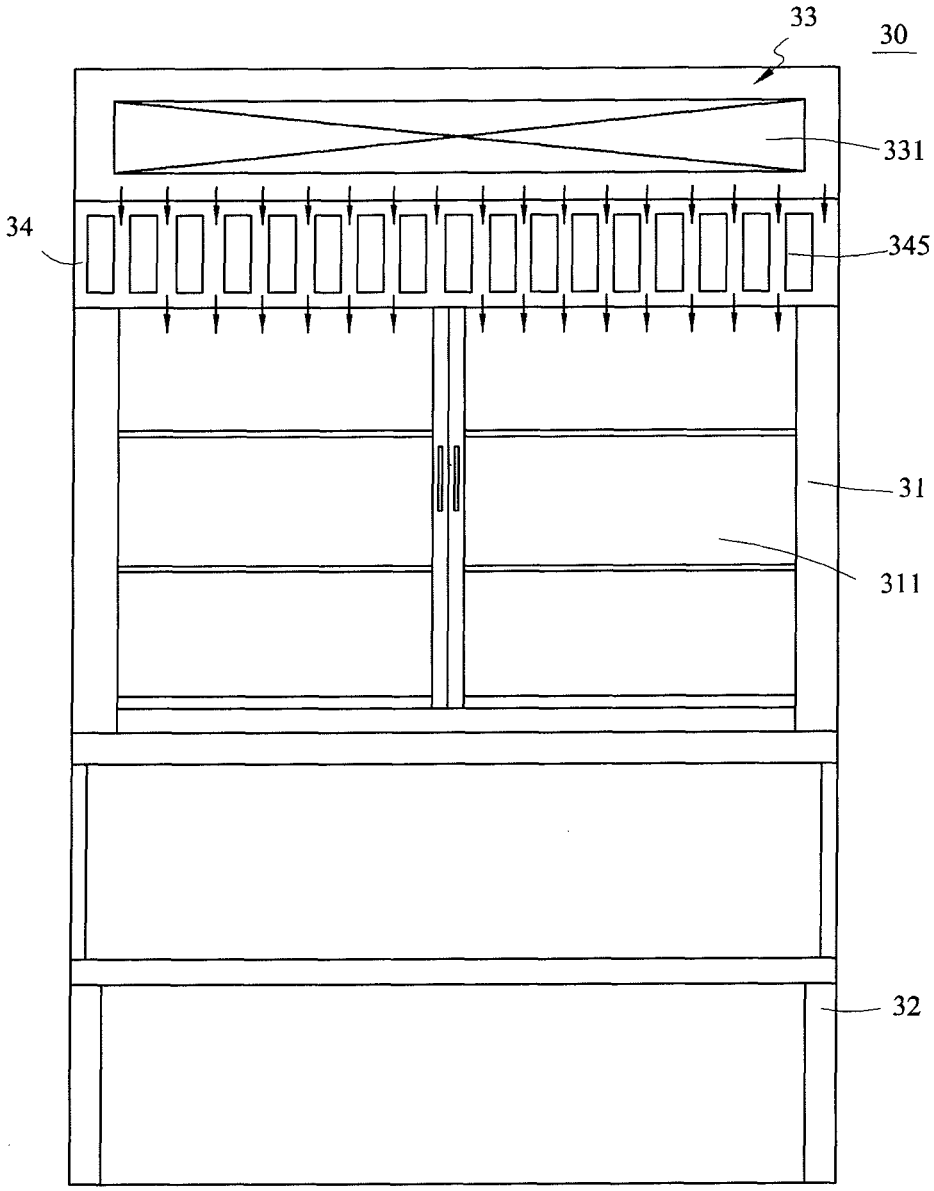
FIG. 5 is a front elevational view of a combination-type refrigerating cabinet according to a third embodiment of the disclosure.
Figure 6:
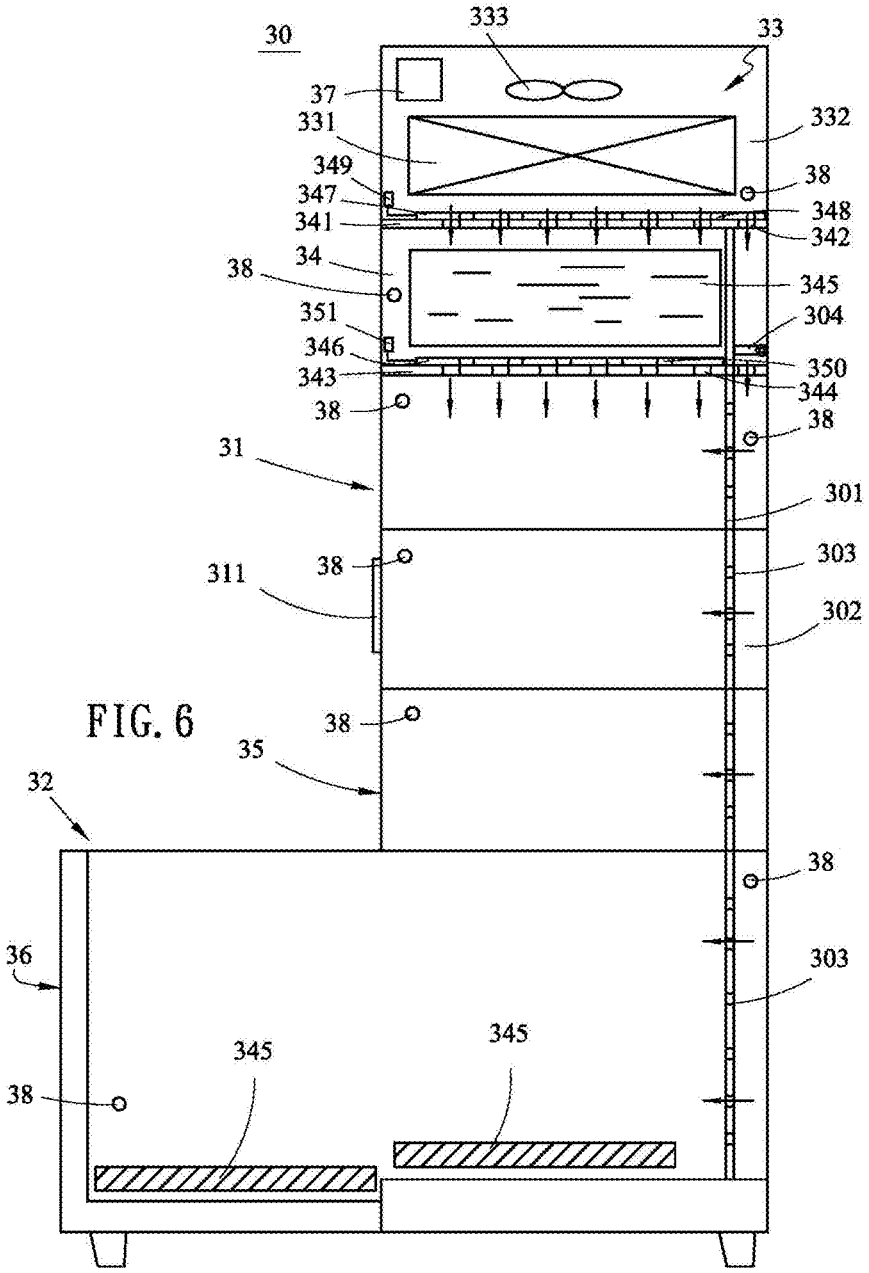
FIG. 6 is a sectional side view of the combination-type refrigerating cabinet according to the third embodiment of the disclosure.
Figure 7:
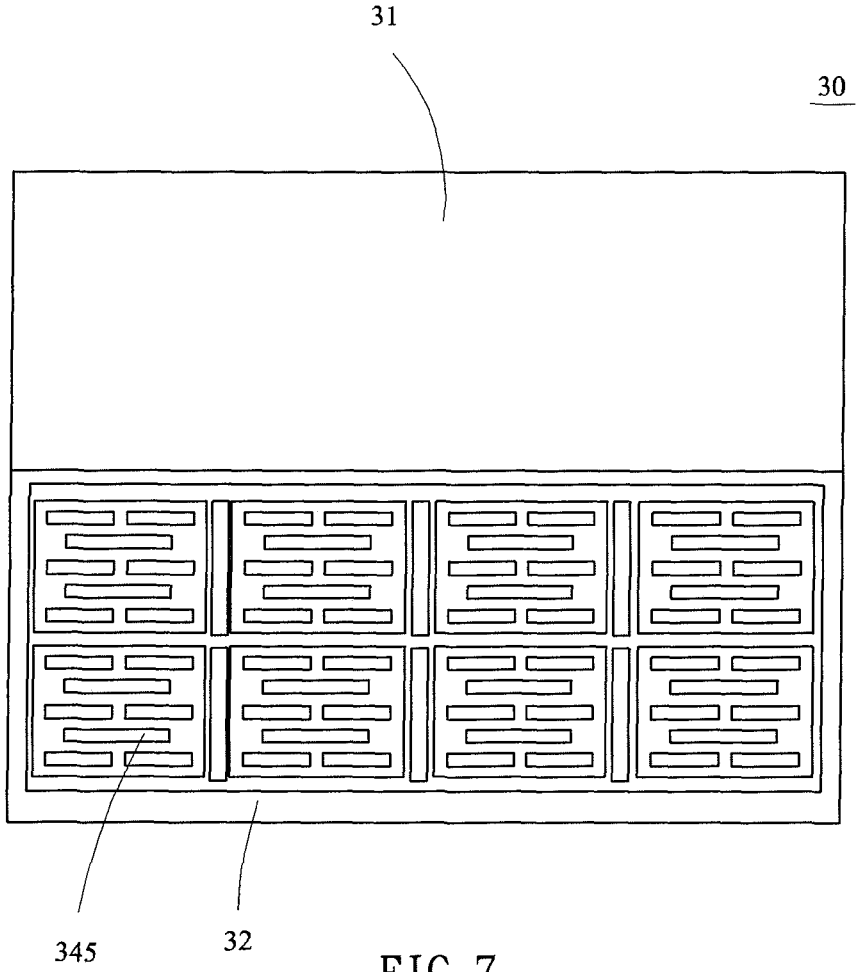
FIG. 7 is a top view of the combination-type refrigerating cabinet according to the third embodiment of the disclosure.

Please refer to FIGS. 5, 6 and 7 that are front elevational view, sectional side view and top view, respectively, of a combination-type refrigerating cabinet 30 according to a third embodiment of the disclosure. In the third embodiment, the combination-type refrigerating cabinet 30 combines a closed refrigerated showcase with an open refrigerated showcase, as shown in FIG. 5, and is also briefly referred to as a combined refrigerated showcase 30 herein. The combined refrigerated showcase 30 includes an upper display zone 31, a lower display zone 32, refrigeration-cycle unit 33, and a cold accumulation chamber 34 located between the upper display zone 31 and the refrigeration-cycle unit 33. The cold accumulation chamber 34 is located atop the upper display zone 31 and below the refrigeration-cycle unit 33. When the combined refrigerated showcase 30 is powered on, the refrigeration-cycle unit 33 is actuated at the same time to start producing cold energy. The refrigeration-cycle unit 33 includes a compressor, a condenser, an expansion valve, and an evaporator 331. The evaporator 331 absorbs heat to produce cold energy, and the condenser releases heat to produce heat energy. Thus, the combined refrigerated showcase 30 is designed to receive cold energy and release heat energy. The evaporator 331 is enclosed in a closed chamber 332 and isolated from external environment. The cold energy produced by the evaporator 331 is sent by a fan 333 to the upper and lower display zones 31, 32 and the cold accumulation chamber 34 of the combined refrigerated showcase 30. In the third embodiment, the refrigeration-cycle unit 33 is described only with the evaporator 331 while other components thereof are omitted herein. However, it is understood the omission of other components of the refrigeration-cycle unit 33 from the description and the drawings does not mean these components are not required but only to enable convenient explanation of the third embodiment and to avoid repeated description of technical features that are known in the prior art. In the third embodiment, the closed chamber 332 enclosing the evaporator 331 therein is communicable with the cold accumulation chamber 34 via a third partition board 341 having one or more third through holes 342 formed thereon; and the cold accumulation chamber 34 and the upper display zone 31 are communicable with each other via a fourth partition board 343 having one or more through holes 344 formed thereon. The upper display zone 31 is a closed refrigerated showcase provided with doors 311 for openably closing it, so that frozen foods or fresh foods can be removed from or put into the upper display zone 31 by opening the doors 311. The lower display zone 32 is an open refrigerated showcase that can be provided or not provided with doors and is used to hold and display foods that require low temperature to keep fresh.

As can be seen from FIG. 6, the combined refrigerated showcase 30 includes an upper and a lower housing 35, 36 for the upper and the lower display zone 31, 32, respectively. A fifth partition board 301 is provided in the upper and lower display-zone housing 35, 36 closer to a rear side thereof, so that a gas passage 302 is formed in the upper and lower display zones 31, 32 behind the fifth partition board 301. The fifth partition board 301 has a plurality of fifth through holes 303 formed thereon to communicate the gas passage 302 with spaces of the upper and lower display zones 31, 32 in front of the fifth partition. The gas passage 302 is also communicable with the closed chamber 332 enclosing the evaporator 331. With these arrangements, cold energy produced by the evaporator 331 of the refrigeration-cycle unit 33 can be separately supplied to the cold accumulation chamber 34 via the third through holes 342 and to the upper and lower display zones 31, 32 via the gas passage 302 and the fifth through holes 303. The cold accumulation chamber 34 has one or more cold accumulators 345 provided therein. The cold energy produced by the refrigeration-cycle unit 33 and supplied to the cold accumulation chamber 34 freezes the cold accumulators 345.

In the third embodiment, the combined refrigerated showcase 30 also includes a controller 37 and a plurality of temperature detectors 38 separately provided in the closed chamber 332 for the evaporator 331, the cold accumulation chamber 34, and the upper and lower display zones 31, 32.

As can be seen from FIG. 7, additional cold accumulators 345 may be provided on a whole inner bottom of the lower display zone 32. The additional cold accumulators 345 may be customized to have sizes suitable for actual dimensions of the lower display zone 32. Therefore, the same effects of maintaining foods in fresh and hydrated state may also be achieved by positioning fresh foods directly on the cold accumulators 345 in the lower display zone 32. The cold accumulators 345 positioned in the lower display zone 32 having been used over a period of time may be replaced with other fully frozen cold accumulators 345 according to a detection result from the temperature detector 38 provided in the lower display zone 32. The cold accumulators 345 used with the disclosure may each continuously supply cold energy for as long as ten or more hours or even more than twenty hours, depending on different applications. Thanks to the constantly developed new liquid cold accumulating materials, most of the currently available cold accumulators may supply cold energy for more than twenty hours. Therefore, in the embodiments of the disclosure, both the cold accumulators 345 and the refrigeration-cycle unit 33 are used for them to work alternately. For example, the cold energy may be supplied from the refrigeration-cycle unit 33 for one day and then from the cold accumulators for another day.

In the case the upper display zone 31 is used to hold and display frozen foods, the temperature needed by the upper display zone 31 would be different from that in the cold accumulation chamber 34. To meet this requirement, first close a sealing gate 304 of the gas passage 302, so that cold energy produced by the refrigeration-cycle unit 33 is supplied only to the cold accumulation chamber 34 to freeze the cold accumulators 345 therein. The cold energy is supplied from the refrigeration-cycle unit 33 via the third through holes 342 on the third partition board 341 into the cold accumulation chamber 34, while the fourth through holes 344 on the fourth partition board 343 are closed by a fourth closing member 346 correspondingly provided atop the fourth partition board 343. The fourth closing member 346 has fourth vents 350 formed thereon. The fourth closing member 346 can be driven by a motor 351 to move under control of the controller 37, so that the fourth vents 350 are aligned with or offset from the fourth through holes 344. When the fourth vents 350 are aligned with the fourth through holes 344, low-temperature gas from the cold accumulation chamber 34 is allowed to pass through the fourth partition board 343 into the display zones 31, 32. On the other hand, when the fourth vents 350 are offset from the fourth through holes 344, no low-temperature gas from the cold accumulation chamber 34 can flow down through the fourth partition board 343 into the display zones 31, 32.

In the event the temperature detector 38 in the cold accumulation chamber 34 detects the temperature therein has dropped below a first preset temperature, indicating the cold accumulators 345 in the cold accumulation chamber 34 have become frozen, the controller 37 will generate a signal to open the sealing gate 304 of the gas passage 302, so that cold energy is supplied from the refrigeration-cycle unit 33 to the upper display zone 31 for the same to have an internal temperature suitable for keeping foods held and displayed in the upper display zone 31 in a cold state. When the upper display zone 31 is detected by corresponding temperature detectors 38 as having an internal temperature lowered to a second preset temperature, the temperature detectors 38 generate a signal to the controller 37 for the latter to stop the refrigeration-cycle unit 33 and control a third closing member 347 to close the third through holes 342 on the third partition board 341 as well as close the sealing gate 304 of the gas passage 302.

The third closing member 347 has third vents 348 formed thereon. The third closing member 347 can be driven by a motor 349 to move under control of the controller 37, so that the third vents 348 are aligned with or offset from the third through holes 342. When the third vents 348 are aligned with the third through holes 342, low-temperature gas from the refrigeration-cycle unit 33 is allowed to pass through the third partition board 341 into the cold accumulation chamber 34. On the other hand, when the third vents 348 are offset from the third through holes 342, no low-temperature gas from the refrigeration-cycle unit 33 can flow through the third partition board 341 down into the cold accumulation chamber 34. At this point, the controller 37 generates a signal to move the fourth closing member 346 and thereby open the fourth through holes 344 on the fourth partition board 343.

When the upper display zone 31 is detected by corresponding temperature detectors 38 as having an internal temperature risen to a third preset temperature, the temperature detectors 38 generate a signal to the controller 37 for the latter to control the fourth closing member 346 to an open position, allowing the cold energy stored by the cold accumulators 345 in the cold accumulation chamber 34 to flow down to the upper display zone 31, so that the upper display zone 31 can maintain at a frozen temperature for a period of time. Then, when the upper display zone 31 or the cold accumulation chamber 34 is detected as having an internal temperature risen to a fourth preset temperature, the refrigeration-cycle unit 33 is actuated again to produce and supply cold energy to the cold accumulation chamber 34 or the upper display zone 31, in order to maintain the cooling effect of the upper display zone 31. In the case the cold accumulation chamber 34 has an internal temperature risen to a level that can no longer maintain the upper display zone 31 at a required operating temperature, the corresponding temperature detector 38 can generate a signal to the controller 37 for the latter to close the sealing gate 304 of the gas passage 302 and the fourth closing member 346, so that cold energy is supplied from the refrigeration-cycle unit 33 to the cold accumulation chamber 34 to lower the internal temperature thereof and freeze the cold accumulators 345 therein, making the cold accumulators 345 prepared for supplying cold energy to the upper display zone 31 for use next time.

Since the lower display zone 32 is generally used to hold and display fresh foods, the cold energy needed to keep the working temperature of the lower display zone 32 is supplied directly from the refrigeration-cycle unit 33 via the gas passage 302 to the lower display zone 32. By repeating the above-described operation cycle, it is possible to use the cold energy to keep the stored foods cold and hydrated for longer time while reducing the number of times of turning on/off the compressor. Further, unlike the prior art, the disclosure does not require any additional freezing unit for freezing the cold accumulators or any charging control unit. Moreover, since the cold accumulators for the disclosure have the junction of automatically keeping desired humidity in the display zones, foods stored and displayed in the display zones can maintain fresh and hydrated for a longer time.

The lower display zone 32 may have a plurality of cold accumulators 345 provided on the whole inner bottom thereof to provide required cold energy and humidity in the lower display zone 32.

The controller 37 is electrically connected to every temperature detector 38, the sealing gate 304, the third closing member 347, and the fourth closing member 346.

An object of the disclosure is to provide a combination-type refrigerating cabinet that uses not only a refrigeration-cycle unit, but also cold accumulators to obtain required cold energy.

Another object of the disclosure is to provide a refrigeration-cycle unit that supplies cold energy to a refrigerated cabinet for a period of time before a preset temperature is reached, and then one or more cold accumulators replace the refrigeration-cycle unit to supply the cold energy. By alternately using the refrigeration-cycle unit and the cold accumulators to supply cold energy to the refrigerated cabinet, it is possible to provide longer cooling time while maintaining an interior of the refrigerated cabinet at a required humidity.

A further object of the disclosure is to provide a combination-type refrigerating cabinet that reduces the number of times of turning on or off a compressor and accordingly indirectly reduces the carbon dioxide emission in the environment.

A still further object of the disclosure is to provide a combination-type refrigerating cabinet that does not require any additional freezing unit for freezing cold accumulators or any charging control unit, and the cold accumulators used for the refrigerating cabinet have the function of automatically maintaining a required humidity in a refrigerated cabinet, so that foods stored in the refrigerated cabinet can keep fresh and hydrated for longer time.

In brief, in the combination-type refrigerating cabinet according to the disclosure, the refrigeration-cycle unit and the cold accumulators work alternately to supply cold energy, so that continuous and prolonged frozen and cooling effects can be achieved while the number of times of turning on or off the compressor is reduced and the carbon dioxide emission in the environment can be indirectly reduced. Further, unlike the prior art, the disclosure does not require any additional freezing unit for freezing the cold accumulators or any charging control unit, and the cold accumulators used therefor have the function of automatically keeping desired humidity in the combination-type refrigerating cabinet, so that foods stored in the combination-type refrigerating cabinet of the disclosure can maintain fresh and hydrated for a longer time.

The disclosure has been described with some embodiments thereof and it is understood that many changes and modifications in the described embodiments can be carried out without departing from the scope and the spirit of the disclosure that is intended to be limited only by the appended claims.

What is claimed is:

1. A combination-type refrigerating cabinet, comprising:

a cabinet body internally defining at least one cold accumulation chamber and a refrigerated cabinet internally having at least one refrigeration chamber; at least one first air passage being provided between the cold accumulation chamber and the refrigerated cabinet; the cold accumulation chamber being internally provided with at least one cold accumulator, and the cold accumulator including a case filled with a liquid cold accumulating material;

a refrigeration-cycle unit for separately supplying cold energy to the cold accumulation chamber and the refrigerated cabinet; and a pipe system being provided between the cabinet body and the refrigeration-cycle unit, and including a cold accumulation chamber pipeline and a refrigerated cabinet pipeline; the cold accumulation chamber pipeline communicating the refrigeration-cycle unit with the cold accumulation chamber, and the refrigerated cabinet pipeline communicating the refrigeration-cycle unit with the refrigerated cabinet;

wherein the refrigerated cabinet internally has multiple refrigeration chambers, and at least one second air passage being provided between any two adjacent refrigeration chambers;

wherein the pipe system has a first end and a second end; the first end of the pipe system being connected to an evaporator of the refrigeration-cycle unit, and the second end of the pipe system being separately connected to the cold accumulation chamber and the refrigerated cabinet; and the evaporator of the refrigeration-cycle unit and the first end of the pipe system being enclosed in a closed space;

wherein the cold accumulation chamber pipeline includes at least one pipe for communicating the evaporator of the refrigeration-cycle unit with the at least one cold accumulation chamber; and the refrigerated cabinet pipeline includes at least one pipe for communicating the evaporator of the refrigeration-cycle unit with the at least one refrigeration chamber in the refrigerated cabinet;

wherein the first air passage is provided with a first closing member for opening or closing the first air passage under control;

wherein the second air passage is provided with a second closing member for opening or closing the second air passage under control;

wherein the first closing member and the second closing member are respectively driven by a corresponding motor to move, so as to open or close the first and the second air passage, respectively;

wherein the first air passage includes a partition board having at least one through hole formed thereon;

wherein the second air passage includes a partition board having at least one through hole formed thereon;

wherein a plurality of temperature detectors are separately provided in the at least one cold accumulation chamber and the at least one refrigeration chamber of the refrigerated cabinet;

wherein the temperature detectors are electrically connected to a controller, and the controller controlling the refrigeration-cycle unit to start or stop operating according to signals generated by the temperature detectors to the controller; and wherein a plurality of valves are separately connected to the pipes of the cold accumulation chamber pipeline and the refrigerated cabinet pipeline of the pipe system, and the valves being controlled by the controller to open or close.

2. The combination-type refrigerating cabinet as claimed in claim 1, wherein the cold accumulation chamber is located a top the refrigerated cabinet.

3. The combination-type refrigerating cabinet as claimed in claim 1, wherein walls of the cabinet body, the cold accumulation chamber, and the refrigerated cabinet all are made of a thermal insulating material, and the thermal insulating material being selected from the group consisting of a polyurethane foaming material, a vacuum insulated material, vacuum insulated panels, and any combination thereof.

* * * * *